United States Patent [19]

Bardasz

[11] 4,396,492

[45] Aug. 2, 1983

[54] METHOD FOR RETARDING CORROSION IN PETROLEUM PROCESSING OPERATION USING N-METHYL PYRROLIDONE

[75] Inventor: Ewa A. Bardasz, Cranford, N.J.

[73] Assignee: Exxon Research and Engineering Co., Florham Park, NJ

[21] Appl. No.: 317,760

[22] Filed: Nov. 3, 1981

[51] Int. Cl.[3] ..... C10G 7/10; C23F 11/12

[52] U.S. Cl. ..... 208/47; 106/14.27; 203/7; 208/323; 208/326; 252/396; 422/7

[58] Field of Search ..... 252/396; 208/47, 323, 208/326; 203/7; 106/14.27; 422/7

[56] References Cited

U.S. PATENT DOCUMENTS

| | | | |
|---|---|---|---|
| 3,180,832 | 4/1965 | Furey | 252/56 |
| 3,429,817 | 2/1969 | Furey et al. | 252/56 |
| 3,843,515 | 10/1974 | MacDonald et al. | 208/326 |
| 3,857,865 | 12/1974 | Sturwold et al. | 260/407 |
| 4,013,549 | 3/1977 | Bushnell | 208/323 |
| 4,057,491 | 11/1977 | Bushnell et al. | 208/321 |
| 4,125,458 | 11/1978 | Bushnell et al. | 208/309 |
| 4,168,226 | 9/1979 | White et al. | 208/321 |
| 4,229,284 | 10/1980 | White et al. | 208/47 |

*Primary Examiner*—Irwin Gluck

*Attorney, Agent, or Firm*—Eugene Zagarella

[57] ABSTRACT

This invention is directed to a method of reducing the amount of corrosion resulting in a petroleum process operation wherein N-methyl pyrrolidone is utilized as one of the components by adding an effective corrosion inhibiting amount of an ester additive formed from a polycarboxylic acid and glycol or glycerol, preferably a dimer acid of linoleic acid and diethylene glycol.

10 Claims, No Drawings

METHOD FOR RETARDING CORROSION IN PETROLEUM PROCESSING OPERATION USING N-METHYL PYRROLIDONE

BACKGROUND OF THE INVENTION

This invention relates to a method of retarding or minimizing the effects of corrosion when N-methyl pyrrolidone is utilized in a petroleum processing operation.

N-methyl pyrrolidone (hereinafter referred to as NMP) has been known to be useful in various petroleum hydrocarbon compositions and processing operations. Such uses include that of a solvent for the separation of olefins, for the recovery of acetone from petroleum gas, for the extraction of naphthalenic hydrocarbons from various hydrocarbon mixtures, as a chemical reaction medium, as a polymer solvent, for use in industrial cleaning, for decolorizing petroleum oils and waxes, in paint removers, as a deicer for jet fuels and gasoline etc. Perhaps the most important and widest industrial use of NMP is as an aromatic extraction solvent in various petroleum refining processes. Illustrative processes are for the separation of benzene, toluene, and xylene or the well-known BTX process, the recovery and separation of relatively pure single-ring aromatics such as xylene, benzene and toluene from relatively light hydrocarbon mixtures known in the industry as the Arosolvan process, and in the extraction of aromatics from lube oil fractions in order to produce lube oils of relatively high VI and UV stability. Within the past ten years or so, a considerable amount of industrial research and development has been expended by the petroleum industry towards the utilization of NMP in lube oil deasphalting, extraction and dewaxing. See for example U.S. Pat. Nos. 3,843,515; 4,013,549; 4,057,491; 4,125,458 and 4,168,226.

While the use of NMP in various petroleum processes has been growing and is for the most part quite successful, there has been one problem associated with its use, that is the corrosion which develops in various processing units.

SUMMARY OF THE INVENTION

Now in accordance with the method of this invention it has been found that corrosion formed in petroleum processing units wherein NMP is utilized can be significantly reduced by using a selected ester of polycarboxylic acid and a glycol/glycerol.

DETAILED DESCRIPTION OF THE INVENTION

This invention relates to a petroleum process wherein N-methyl pyrrolidone is used as one of the components and where an effective corrosion inhibiting amount of a selected ester formed from a combination of a polycarboxylic acid and a glycol or glycerol is added to the system.

The selected ester useful as a corrosion inhibitor in the petroleum process of this invention is generally any oil soluble hydroxy substituted ester of a polycarboxylic acid. More particularly, the ester component used in this invention is derived from the esterification of a polycarboxylic acid with a glycol or glycerol, preferably glycol.

Such an ester may be a partial, di- or polyester with typical formulas of the ester represented by the following general formulas when using a glycol:

$$HO—R—OOC—R''—COOH \quad (1)$$

$$HO—R—OOC—R''—COOR'—OH \quad (2)$$

$$HO—R—OOC—R''—COOR—OOC—R''—COOR'—OH \quad (3)$$

wherein R'' is the hydrocarbon radical of said acid and each R and R' may be the same or different hydrocarbon radicals associated with a glycol or diol as hereinafter defined. It will, of course, be appreciated that esters of the type illustrated by the foregoing formulas can be obtained by esterifying a polycarboxylic acid, or a mixture of such acids, with a diol or mixture of such diols.

The polycarboxylic acid used in preparing the ester may be an aliphatic saturated or unsaturated acid and will generally have a total of about 24 to about 90, preferably about 24 to about 60 carbon atoms and about 2 to about 4, preferably about 2 to about 3 and more preferably about 2 carboxylic acid groups with at least about 9 up to about 42 carbon atoms, preferably about 12 to about 42 and more preferably about 16 to about 22 carbon atoms between the carboxylic acid groups.

The oil insoluble glycol which is reacted with the polycarboxylic acid may be an alkane diol, i.e. alkylene glycol or an oxa-alkane diol, i.e. polyalkylene glycol, straight chain or branched. The alkane diol may have from about 2 to about 12 carbon atoms and preferably about 2 to about 5 carbon atoms in the molecule and the oxa-alkane diol will, generally, have from about 4 to about 200, preferably about 4 to about 100 carbon atoms. The oxa-alkane diol (polyalkylene glycol) will, of course, contain periodically repeating groups of the formula:

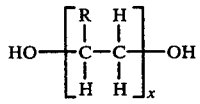

wherein R may be H, $CH_3$, $C_2H_5$ or $C_3H_7$, and x is 2 to 100, preferably 2 to 25. The preferred alkane diol or alkylene glycol is ethylene glycol and the preferred oxa-alkane diol or polyalkylene glycol is diethylene glycol. As indicated previously, glycerol may also be used in preparing the ester of polycarboxylic acid and it is contemplated that such component will also include its higher molecular weight analogues.

While any of the esters as set forth above can be effectively used, best results are obtained with such compounds wherein the carboxyl groups of the polycarboxylic acid are separated from each other by from about 16 to about 22 carbon atoms and wherein the hydroxy groups are separated from the closest carboxyl group by from about 2 to about 12 carbon atoms. Particularly desirable results have been obtained with additives prepared by esterifying a dimer of a fatty acid, particularly those containing conjugated unsaturation with a polyhydroxy compound. Such dimers are, of course, clearly taught in U.S. Pat. No. 3,180,832 which was granted on Apr. 27, 1965 and U.S. Pat. No. 3,429,817 which was granted on Feb. 25, 1969, and as there indicated, the hydrocarbon portion of the dimer or dicarboxylic acid thus obtained may contain a six member ring. The formation of the dimer from linoleic acid, oleic acid and mixtures of these acids is illustrated by the following:

A.

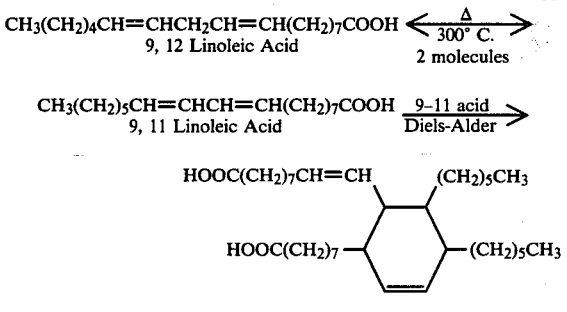

Linoleic Acid Dimer (dilinoleic acid)

B.

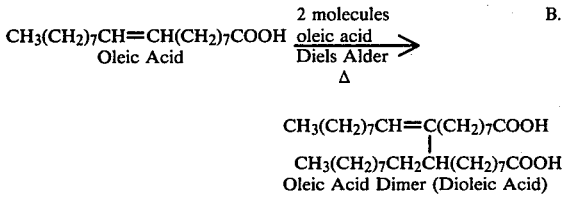

Oleic Acid Dimer (Dioleic Acid)

C.

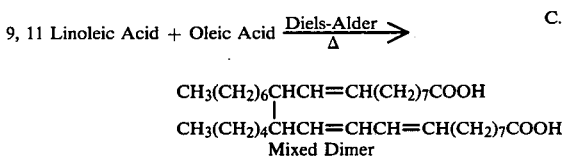

Mixed Dimer

It will, of course, be appreciated that while the reactions illustrated produce the dimers, commercial application of the reactions will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention.

The preferred hydroxy-substituted ester additives useful in the present invention will be the reaction product of a dimerized fatty acid, such as those illustrated, and an oil insoluble glycol and may be produced by various techniques. As previously pointed out, the preferred acid dimers are the dimers of linoleic acid, oleic acid or the mixed dimer of linoleic and oleic acids, which may also contain some monomer as well as trimer. Other specifically satisfactory glycols in addition to ethylene glycol and polyethylene glycol are, for example, propylene glycol, polypropylene glycol, butylene glycol, polybutylene glycol and the like.

The process of this invention will generally include any petroleum process operation wherein a hydrocarbon feed is being treated or processed and wherein NMP is used as one of the component ingredients. More particularly, this invention will involve a hydrocarbon feed which is contacted with N-methyl pyrrolidone as solvent, preferably in an extraction operation.

While any hydrocarbon feed may be used, preferable feedstocks are those common to the petroleum refinery industry, especially lube oil feedstocks. Lube oil feeds comprise petroleum fractions having an initial boiling point of above about 500° F. (260° C.). These fractions include deasphalted oils and/or distillate lube oil fractions boiling within the range of about 600° F. (311° C.) to 1050° F. (566° C.) (at atmospheric pressure) and contain between about 5 to about 70% (by weight) of polar and aromatic compounds such as substituted benzenes, naphthalenes, anthracenes and phenanthracenes, characterized by having a carbon content typically in the range of $C_{15}$-$C_{50}$. Nonlimiting examples of useful feedstocks include crude oil distillates and deasphalted resids, those fractions of catalytically cracked cycle oils, coker distillates and/or thermally cracked oils boiling above about 600° F. (311° C.) and the like. These fractions may be derived from petroleum crude oils, shale oils, tar sand oils, and the like. These fractions may come from any source, such as the paraffinic crudes obtained from Aramco, Kuwait, The Panhandle, North Louisiana, etc naphthenic crudes such as Tia Juana and Coastal crudes, etc., as well as the relatively heavy feedstocks such as bright stocks having a boiling range of 1050° F.+ (566° C.+) and synthetic feedstocks derived from Athabasca Tar Sands, etc.

The amount of polycarboxylic acid glycol/glycerol ester used in this invention will be an effective corrosion inhibiting amount and can vary from about 0.001 to about 10% by weight, preferably from about 0.01 to about 5% by weight and more preferably from about 0.02 to about 3% by weight based on the total weight of the hydrocarbon composition or system being used in the process operation.

Other treating materials and additives conventionally used in petroleum process operations may of course be included in the composition being processed.

The following examples are further illustrative of this invention and are not intended to be construed as limitations thereof.

EXAMPLE I

A sample comprising N-methyl pyrrolidone was contacted with an iron specimen and tested for iron corrosion at a temperature of 25° C. using the Polarization Device for Petroleum Systems (PDPS) which is described in U.S. Pat. No. 4,169,768 issued Oct. 2, 1979. The iron corrosion rate was 405 μm/a.

Adding 0.05 wt% of an ester additive, formed by esterification of a dimer acid of linoleic acid and diethylene glycol, to the N-methyl pyrrolidone and again testing for iron corrosion using PDPS, the corrosion rate dropped to 16 μm/a.

Another test was made after adding 0.1 wt% of the same ester described above to the N-methyl pyrrolidone system. The iron corrosion rate was found to be 7.5 μm/a.

EXAMPLE II

Another sample comprising 95% by weight N-methyl pyrrolidone and 5% by weight water was contacted with an iron speciman and tested for iron corrosion using PDPS as described in Example I. The iron corrosion rate was 487 μm/a.

Adding 0.05 wt% of an ester additive formed by esterfication of a dimer acid of linoleic acid and diethylene glycol to the same NMP/water system and again testing for iron corrosion using PDPS, the corrosion rate was 22 μm/a.

Another test was made after adding 0.1 wt% of the same ester additive to the NMP/water system. The iron corrosion rate was found to be 10 μm/a.

What is claimed is:

1. In a petroleum process operation wherein N-methyl pyrrolidone is used as one of the components in a hydrocarbon system, the improvement comprising adding an effective corrosion inhibiting amount of an ester additive formed from the combination of a polycarboxylic acid with glycol or glycerol to reduce the formation of corrosion.

2. The process of claim 1 wherein said ester additive is used in an amount of from about 0.001 to about 10% by weight based on the total weight of the hydrocarbon system.

3. The process of claim 2 wherein said ester additive is formed from a dicarboxylic acid having from about 9 to about 42 carbon atoms between carboxylic acid groups and a glycol which is selected from the group consisting of alkane diols having from about 2 to about 12 carbon atoms or an oxane-alkane diol having from about 4 to about 200 carbon atoms.

4. The process of claim 3 wherein said ester additive is used in an amount of from about 0.01 to about 5% by weight based on the total weight of the hydrocarbon system.

5. The process of claim 4 wherein said ester additive is formed from a dimer acid of a conjugated fatty acid having from about 16 to about 22 carbon atoms between carboxylic acid groups.

6. The process of claim 5 wherein said ester is formed by esterification of a dimer acid of linoleic acid and diethylene glycol.

7. The process of claim 6 wherein said ester additive is used in an amount of from about 0.02 to about 3% by weight based on the total weight of the hydrocarbon composition.

8. The process of claim 4 wherein said process operation is an extraction operation.

9. The process of claim 8 wherein said ester additive is formed from a dimer acid of a conjugated fatty acid having from about 16 to about 22 carbon atoms between carboxylic acid groups.

10. The process of claim 9 wherein said ester is formed by esterification of a dimer acid of linoleic acid and diethylene glycol.

* * * * *